US005674828A

United States Patent [19]

Knowlton et al.

[11] Patent Number: 5,674,828

[45] Date of Patent: Oct. 7, 1997

[54] AQUEOUS LIQUID COMPOSITIONS COMPRISING PERACID COMPOUNDS AND DEFINED N-OXIDE COMPOUNDS

[75] Inventors: Charles Nathaniel Knowlton, Glen Rock; Janet Coope, Hackensack; Daniel Kuzmenka, Wallington; Mark Stephen Naser, Hamburg; Leslie Jo Morgan, Chatham, all of N.J.

[73] Assignee: Lever Brothers Company, Division of Conopco, Inc., New York, N.Y.

[21] Appl. No.: 628,065

[22] Filed: Apr. 8, 1996

[51] Int. Cl.[6] ..... C11D 3/39; C11D 7/38

[52] U.S. Cl. ..... 510/372; 510/503; 252/186.26

[58] Field of Search ..... 252/186.26, 186.42; 510/303, 309, 310, 372, 373, 375, 503

[56] References Cited

U.S. PATENT DOCUMENTS

| | | | |
|---|---|---|---|
| 4,077,911 | 3/1978 | Okumura et al. | 510/419 |
| 4,900,469 | 2/1990 | Farr et al. | 252/186.26 |
| 4,992,194 | 2/1991 | Liberati et al. | 510/303 |
| 5,180,514 | 1/1993 | Farr et al. | 252/186.25 |
| 5,244,593 | 9/1993 | Roselle et al. | 510/127 |
| 5,326,494 | 7/1994 | Woods | 252/186.27 |
| 5,380,456 | 1/1995 | Woods | 252/186.27 |
| 5,397,501 | 3/1995 | Coope | 510/375 |

FOREIGN PATENT DOCUMENTS

| | | |
|---|---|---|
| 290223 | 5/1988 | European Pat. Off. . |
| 564250 | 10/1993 | European Pat. Off. . |

OTHER PUBLICATIONS

Dissertation entitled "A Study of the Acidity and Complexing Properties of Nitrilotriacetic Acid N–Oxide", Ethylene Diaminetetraacetatic Acid N,N'–Dioxide, Dipicolinic Acid N–Oxide, and 8–Hydroxyquinoline–5–Sulfonic Acid N–Oxide in Aqueous Solution to Larry Freyer (Aug. 1975).

Article in Journal of Chem. Soc. Perkin Trans entitled "Mechanisms of Peroxide Stabilization". An Investigation of Some Reactions of Hydrogen Peroxide in the Presence of Aminophosphonic Acids to Croft et al. (1992) No month available.

*Primary Examiner*—Paul Lieberman
*Assistant Examiner*—Caroline L. Dusheck
*Attorney, Agent, or Firm*—Ronald A. Koatz

[57] ABSTRACT

The present invention relates to liquid detergent compositions comprising:

(1) 1–80% by wt. surfactant;

(2) defined peroxyacid; and (3) 0.01–20% by wt. of N-oxide compound.

The N-oxide compounds help to extend the half life of the peracid bleaches in such compositions. The invention further relates to a method of incorporating stability of surfactant compositions comprising peracid bleaches which method comprises adding 0.01–2.0% by wt. of said N-oxide compound to the composition.

10 Claims, No Drawings

AQUEOUS LIQUID COMPOSITIONS COMPRISING PERACID COMPOUNDS AND DEFINED N-OXIDE COMPOUNDS

FIELD OF THE INVENTION

The present invention relates to aqueous liquid detergent compositions (also known as heavy duty liquids or HDLs) comprising both peracid compounds and defined N-oxide compounds as stabilizing agents for the peracids.

BACKGROUND

Aqueous heavy duty liquid compositions containing peroxy acids are known in the art. U.S. Pat. No. 4,642,198 to Humphreys et al., for example, teaches an aqueous liquid bleach composition comprising a solid, particulate, substantially water-insoluble organic peroxy acid stably suspended in a surfactant structured liquid. U.S. Pat. No. 4,992,194 to Liberati et al. and European Publication No. 564,250 (assigned to Unilever) relate to aqueous liquid compositions containing organic peroxy acids. None of these references teach the use of specific N-oxide compounds nor do they teach or suggest that these N-oxide compounds can be used to enhance stabilization of the peroxy acids.

In general, peroxy acids are prone to lose activity in the presence of trace transition metals normally found in aqueous surfactant liquids. Accordingly, it is necessary to protect the peroxy acids from such attacks.

One commonly used, commercially available method of stabilizing such peroxy acids in aqueous heavy duty liquids is by using certain types of transition metal sequestrant stabilizing agents. Thus, for example, U.S. Pat. No. 4,992,194 to Liberati teaches the use of organic phosphonic acids or phosphonates (e.g., Dequest®) as metal ion complexing agents. These sequestrants are different than the N-oxide compounds of the present invention.

U.S. Pat. No. 4,992,194 also teaches ethylene diamine tetraacetic acid (EDTA) and salts of EDTA as metal ion complexing agents (Further EDTA generally is known as a builder for use in aqueous liquid compositions). As shown in the examples, although EDTA stabilizes peracid in an HDL formulation, EDTA oxide is 50% better.

U.S. Pat. No. 4,992,194 to Liberati et al. also teaches dipicolinic N-oxide as a complexing agent. Such aromatic N-oxides are structurally different than the specific class of claimed N-oxide compounds of the subject invention.

As noted, applicants have unexpectedly discovered a specific class of N-oxide stabilizer compounds which can be used to extend the half life of the peracid in aqueous bleach compositions. An examples of these non-aromatic N-oxide compounds includes N,N'-dioxides such as ethylenediaminetetraacetate-N,N'dioxide (EDTA oxide).

Applicants are aware of no art teaching the specific class of N-oxide compounds of the invention in bleach containing aqueous compositions, probably because they were never previously recognized for their enhanced stabilizing effect on peracids.

Finally, there is a 1947 dissertation to Larry Freyer entitled "A Study of the Acidity and Complexing Properties of Nitrolacetic Acid N-Oxide, Ethylenediamine Tetraacetic Acid N,N'Dioxide, Dipicolinic Acid N-Oxide, and 8-Hydroxyquinoline-5-sulfonic Acid N-Oxide in Aqueous Solution (Larry Freyer, Texas A & M University, PhD, 1975, in Inorganic Chemistry). This reference shows only the sequestrant properties of EDTA or of dioxide and other oxides and does not discuss HDLs or HDLs with peracids.

In short, there is no art teaching or suggesting bleach containing aqueous liquids and the specific N-oxide compounds of the invention.

BRIEF SUMMARY OF THE INVENTION

The present invention is directed to peroxy acid bleach containing, aqueous, heavy duty liquids comprising a specific class of N-oxide stabilizer for the peroxy acids in the compositions.

In particular, the invention comprises aqueous liquid compositions comprising:

(1) 1 to 80%, preferably 15–65% by wt. of a surfactant selected from the group consisting of anionic, nonionic, cationic, amphoteric and zwitterionic surfactants and mixtures thereof;

(2) 0.1 to 40%, preferably 1 to 10% by wt. of a solid, substantially water insoluble peroxyacid containing one or two peroxy groups that can be aliphatic or aromatic; and (3) 0.01 to 10% by wt., preferably 0.1 to 5% of an N-oxide of general formula

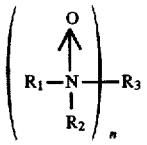

wherein:

$R_1$ and $R_2$ are independently selected from the group consisting of $CH_2CO_2^-$, $CH_2PO_3^-$, $CH_2CO_2H$ and $CH_2PO_3H_2$;

When n is 1, $R_3$ is straight chain or branched $C_1$ to $C_{10}$ alkyl, $CH_2CO_2^-$, $CH_2PO_3^-$, $CH_2CO_2H$, $CH_2PO_3H$, ethoxyalkyl, alkylaminoacetate, polyalkylaminoacetate, alkylaminoacetate N-oxide or polyalkylaminoacetate N-oxide;

When n is 2 to 4, $R_3$ is straight or branched $C_1$ to $C_{10}$ alkylene, ethoxyalkylene, alkylene aminoacetate, polyalkylene aminoacetate, alkylene aminoacetate N-oxide or polyalkylene aminoacetate N-oxide;

n=1 to 4

Preferably, the composition also comprises builder.

In another embodiment, it can also be used in a "pH jump" system.

DETAILED DESCRIPTION OF THE INVENTION

The present invention is directed to peroxy acid bleach containing aqueous liquid compositions comprising a specific class of N-oxide stabilizer for stabilizing the peroxy acids in the liquid composition.

In a second embodiment of the invention, the invention is directed to a method of stabilizing peroxy acid present in aqueous liquid compositions wherein said method comprises adding the defined N-oxide compound to the compositions.

The components of the composition are described in more detail below:

Surfactants

One component of the present invention will be that of a surfactant. The surface-active material may be naturally derived, such as soap or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range from 1% to 80% by weight, preferably being from about 15% to about 65%.

It should be noted that, in one embodiment of the invention, the liquids of the invention may be used in lamellar structured or so-called "duotropic" liquids. The invention would be expected to work equally well, however, in duotropic or isotropic compositions.

When used, lamellar dispersions are used to endow properties such as consumer-preferred flow behavior and/or turbid appearance. Many are also capable of suspending particulate solids such as detergency builders or abrasive particles. Examples of such structured liquids without suspended solids are given in U.S. Pat. No. 4,244,840, while examples where solid particles are suspended are disclosed in specifications EP-A-160,342; EP-A-38,101; EP-A-104,452 and also in the aforementioned U.S. Pat. No. 4,244,840. Others are disclosed in European Patent Specification EP-A-151,884, where the lamellar droplet are called 'spherulites'.

The presence of lamellar droplets in a liquid detergent product may be detected by means known to those skilled in the art, for example optical techniques, various rheometrical measurements, X-ray or neutron diffraction, and electron microscopy.

The droplets consists of an onion-like configuration of concentric bi-layers of surfactant molecules, between which is trapped water or electrolyte solution (aqueous phase). Systems in which such droplets are close-packed provide a very desirable combination of physical stability and solid-suspending properties with useful flow properties.

In such liquids, there is a constant balance sought between stability of the liquid (generally, higher volume fraction of the dispersed lamellar phase, i.e., droplets, give better stability), the viscosity of the liquid (i.e., it should be viscous enough to be stable but not so viscous as to be unpourable) and solid-suspending capacity (i.e., volume fraction high enough to provide stability but not so high as to cause unpourable viscosity).

A complicating factor in the relationship between stability and viscosity on the one hand and, on the other, the volume fraction of the lamellar droplets is the degree of flocculation of the droplets. When flocculation occurs between the lamellar droplets at a given volume fraction, the viscosity of the corresponding product will increase owing to the formation of a network throughout the liquid. Flocculation may also lead to instability because deformation of the lamellar droplets, owing to flocculation, will make their packing more efficient. Consequently, more lamellar droplets will be required for stabilization by the space-filling mechanism, which will again lead to a further increase of the viscosity.

The volume fraction of droplets is increased by increasing the surfactant concentration and flocculation between the lamellar droplets occurs when a certain threshold value of the electrolyte concentration is crossed at a given level of surfactant (and fixed ratio between any different surfactant components). Thus, in practice, the effects referred to above mean that there is a limit to the amounts of surfactant and electrolyte which can be incorporated whilst still having an acceptable product. In principle, higher surfactant levels are required for increased detergency (cleaning performance). Increased electrolyte levels can also be used for better detergency, or are sometimes sought for secondary benefits such as building.

In U.S. Pat. No. 5,147,576 to Montague et al. it was found that addition of a deflocculating polymer allowed incorporation of more surfactant and/or electrolyte without compromising stability or making the compositions unpourable. The deflocculating polymer is as defined in Montague et al. incorporated by reference into the subject application. The level of deflocculating polymer in the present invention is 0.1 to 20% by weight, preferably 0.5 to 5% by wt., most preferably 1% to 3% by wt.

In such lamellar or duotropic compositions the amount of surfactant used is generally minimum about 20% to about 80%, preferably 25% to 50% by wt. of the composition.

Synthetic anionic surfactants used (in non-structured isotropic liquids or structured duotropic liquids) are usually water-soluble alkali metal salts of organic sulfates and sulfonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulfates, especially those obtained by sulphating higher ($C_8$–$C_{18}$) alcohols produced for example from tallow or coconut oil; sodium and ammonium alkyl ($C_9$–$C_{20}$) aryl (e.g. benzene) sulfonates, particularly sodium linear secondary alkyl ($C_{10}$–$C_{15}$) benzene sulfonates; sodium alkyl glyceryl ether sulfates, especially those ethers of the higher alcohols derived from tallow or coconut oil and synthetic alcohols derived from petroleum; sodium coconut oil fatty acid monoglyceride sulfates and sulfonates; sodium and ammonium salts of sulfuric acid esters of higher ($C_9$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and ammonium salts of fatty acid amides of methyl taurine; alkane monosulfonates such as those derived by reacting alpha-olefins ($C_8$–$C_{20}$) with sodium bisulfite and those derived by reacting paraffins with $SO_2$ and $Cl_2$ and then hydrolyzing with a base to produce a random sulfonate; sodium and ammonium $C_7$–$C_{12}$ dialkyl sulfosuccinates; and olefinic sulfonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulfonates; sodium ($C_{16}$–$C_{18}$) alkyl sulfates and sodium ($C_{16}$–$C_{18}$) alkyl ether sulfates.

Examples of suitable nonionic surface-active compounds which may be used preferably together with the anionic surface active compounds, include in particular, the reaction products of alkylene oxides, usually ethylene oxide, with alkyl ($C_6$–$C_{22}$) phenols, generally 2–25 EO, i.e., 2–25 units of ethylene oxide per molecule; the condensation products of aliphatic ($C_8$–$C_{18}$) primary or secondary linear or branched alcohols with ethylene oxide, generally 2–30 EO, and products made by condensation of ethylene oxide with the reaction products of propylene oxide and ethylene diamine. Other so-called nonionic surface-actives include alkyl polyglucosides, esters of fatty acids and glucosides, long chain tertiary amine oxides, long chain tertiary phosphine oxides and dialkyl sulfoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

Electrolyte/Builder

Although the compositions of the invention may be isotropic, if the composition is structured, it should contain an amount of electrolyte sufficient to bring about the structuring of the detergent surfactant material. As noted, there is no preference between isotropic or duotropic liquid so that the invention would be expected to work equally well in either composition.

As used herein, the term electrolyte means any ionic water-soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g the order of addition of components. On the other hand, the term 'salts' includes all organic and inorganic materials which may be included, other than surfactants and water, whether or not they are ionic, and this term encompasses the sub-set of the electrolytes (water-soluble materials).

Preferably though, the compositions contain from 1% to 60%, more preferably from 7 to 45%, most preferably from 15% to 30% of a salting-out electrolyte. Salting-out electrolyte has the meaning ascribed to in specification EP-A-79646. Optionally, some salting-in electrolyte (as defined in the latter specification) may also be included, provided if of a kind and in an amount compatible with the other components and the compositions is still in accordance with the definition of the invention claimed herein.

Some or all of the electrolyte (whether salting-in or salting-out), or any substantially water-insoluble salt which may be present, may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1,302,543.

Examples of organic detergency builders, when present, include the alkaline metal, ammonium and substituted ammonium polyacetates, carboxylates, polycarboxylates, polyacetyl carboxylates, carboxymethyl oxysuccinates, carboxymethyloxymalonates, ethylene diamine-N,N, disuccinic acid salts, ethylene diamine N, N-tetracarboxylate salts, polyepoxysuccinates, oxydiacetates, triethylene tetramine hexacetic acid salts, N-alkyl imino diacetates or dipropionates, alpha sulpho-fatty acid salts, dipicolinic acid salts, oxidized polysaccharides, polyhydroxysulphonates and mixtures thereof.

Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid, tartrate mono succinate and tartrate disuccinate.

Peroxy Acid

Peroxyacids usable in this invention are solid and substantially water insoluble compounds. In general, the organic peroxyacids can contain one or two peroxy groups and can be either aliphatic or aromatic. Examples include alkylperoxy acids such as peroxylauric acid and peroxystearic acids, arylperoxyacids such as peroxybenzoic acid, diperoxy acids such as 1,12-diperoxydodecanedioic acid (DPDA). More preferred are sulfone substituted aliphatic and aromatic peracids such as 6,6'-sulfonyl bisperoxyhexanoic acid and 4,4'-sulfonylbisperoxybenzoic acid (SBPB).

Most preferred are mono- or di- percarboxylic amido or imido acids. The mono-percarboxylic acids are of the general formula:

$$R(R^1N)_nC(\overset{O}{\overset{\|}{}}NR^2)_m-R^3-\overset{O}{\overset{\|}{C}}OOM$$

wherein:

R is selected from the group consisting of $C_1$–$C_{16}$ alkyl, $C_3$–$C_{16}$ cycloalkyl and $C_6$–$C_{12}$ aryl radicals;

$R^1$ is selected from the group consisting of hydrogen, $C_1$–$C_{16}$ alkyl, $C_3$–$C_{16}$ cycloalkyl and $C_6$–$C_{12}$ aryl radicals;

$R^2$ is selected from the group consisting of hydrogen, $C_1$–$C_{16}$ alkyl, $C_3$–$C_{16}$ cycloalkyl and $C_6$–$C_{12}$ aryl radicals and a carbonyl radical that can form a ring together with R when $R^3$ is arylene;

$R^3$ is selected from the group consisting of $C_1$–$C_{16}$ alkylene, $C_5$–$C_{12}$ cycloalkylene and $C_6$–$C_{12}$ arylene radicals;

n and m are integers whose sum is 1; and

M is selected from the group consisting of hydrogen, alkali metal, alkaline earth metal, ammonium and alkanolammonium cations and radicals.

The di-percarboxylic acids of the present invention may be of the general formula:

$$MOO\overset{O}{\overset{\|}{C}}R^4(R^5N)_nC(\overset{O}{\overset{\|}{}}NR^6)_{n'}-R^3-(R^6N)_{m'}C(\overset{O}{\overset{\|}{}}NR^5)_mR^4\overset{O}{\overset{\|}{C}}OOM$$

wherein:

$R^4$ is selected from the group consisting of $C_1$–$C_{12}$ alkylene, $C_5$–$C_{12}$ cycloalkylene, $C_6$–$C_{12}$ arylene and radical combinations thereof;

$R^5$ is selected from the group consisting of hydrogen, $C_1$–$C_{16}$ alkyl and $C_6$–$C_{12}$ aryl radicals and a carbonyl radical that can form a ring together with $R^3$;

$R^6$ is selected from the group consisting of hydrogen, $C_1$–$C_{16}$ alkyl land $C_6$–$C_{12}$ aryl radicals and a radical that can form a $C_3$–$C_{12}$ ring together with $R^3$;

$R^3$ is selected from the group consisting of $C_1$–$C_{12}$ alkylene, $C_5$–$C_{12}$ cycloalkylene and $C_6$–$C_{12}$ arylene radicals;

n' and n" each are an integer chosen such that the sum thereof is 1;

m' and m" each are an integer chosen such that the sum thereof is 1; and

M is selected from the group consisting of hydrogen, alkali metal, alkaline earth metal, ammonium and alkanolammonium cations and radicals.

Amounts of the amido or imido peroxyacids of the present invention may range from about 0.1 to about 40%, preferably from about 1 to about 10% by weight.

Preferably, the peroxyacid is an amide peracid. More preferably, the peroxyacid is selected from the group of amido peracids consisting of N,N'-Terephthaloyl-di(6-aminopercarboxycaproic acid) (TPCAP); N,N'-Di(4-percarboxybenzoyl)piperazine (PCBPIP); N,N'-Di(4-Percarboxybenzoyl)ethylenediamine (PCBED); N,N'-di(4-percarboxybenzoyl)-1,4-butanediamine (PCBBD); N,N'-Di(4-Percarboxyaniline)terephthalate (DPCAT); N,N'-Di(4-Percarboxybenzoyl)-1,4-diaminocyclohexane (PCBHEX); N,N'-Terephthaloyl-di(4-amino peroxybutanoic acid) (TPBUTY); N,N'-Terphthaloyl-di(8-amino peroxyoctanoic acid) (TPOCT); N,N'-Di(percarboxyadipoyl) phenylenediamine (DPAPD); and N,N'-Succinoyl-di(4-percarboxy)aniline (SDPCA).

Other peroxyacids which may be used include PAP as disclosed in U.S. Pat. No. 5,061,807 to Gethoffer; and the amidoperoxy acids disclosed in U.S. Pat. Nos. 4,909,953 to Sadowski and U.S. Pat. No. 5,055,210 to Getty, all of which are incorporated by reference into the subject application.

Upon dispersal in a wash water, the initial amount of peroxyacid should range in amount to yield anywhere from about 0.05 to about 250 ppm active oxygen per liter of water, preferably between about 1 to 50 ppm. Surfactant should be present in the wash water from about 0.05 to 3.0 grams per liter, preferably from 0.15 to 2.4 grams per liter. When present, the builder amount should range from about 0.1 to 3.0 grams per liter.

Buffer or pH Adjusting System

It is advantageous to employ a system to adjust pH, known as a "pH jump" system. It is well-known that organic peroxyacid bleaches are most stable at low pH (3–6), whereas they are most effective as bleaches in moderately alkaline pH (7–9) solution. Peroxyacids (e.g., DPDA) cannot easily be incorporated into conventional alkaline HDL because of chemical instability. To achieve the required pH regimes, a pH jump system may be employed to keep the pH of the product low for peracid stability during storage, yet allow it to become moderately high (e.g., 7–9) in a wash water for bleaching and detergency efficacy. One pH jump system is borax $10H_2O$/polyol. Borate ion and certain cis-1,2-polyols complex when concentrated to cause a reduction in pH. Upon dilution, the complex dissociates, liberating free borate to raise the pH. Examples of polyols which exhibit this complexing mechanism with borate include catechol, galactitol, fructose, sorbitol and pinacol.

For economic reasons, sorbitol is the preferred polyol. Preferably, it is used in formulation in an amount from about 1 to 25% by weight, more preferably 3 to 15% by wt. of the composition. To achieve the desired concentrate pH of less than 7, ratios greater than about 1:1 of polyol to borax are usually required. Therefore, the preferred ratio of polyol to borax should range anywhere from about 1:1 to about 10:1, although the range may be as broad as 1:10 to 10:1.

Borate compounds such as boric acid, boric oxide, borax with sodium ortho- or pyroborate may also be suitable as the borate component. Generally, the borate or boron compound comprises 0.5% to 10.0%, preferably 1.0 to 5% by wt. of the composition.

In general, pH of the compositions may rang from 4–8, preferably pH 5–7.

N-oxide Stabilizer

The stabilizer of the invention is primarily defined by its ability to extend the half-life of peracid in aqueous surfactant bleach compositions. It is well known in the art that transition metal ions catalyze the decomposition of peroxyacids in aqueous alkaline solution by a mechanism such as that shown below (see J. A. Howard in "The Chemistry of Peroxides", p. 251 S. Patai, ed., John Wiley & Sons (1983)).

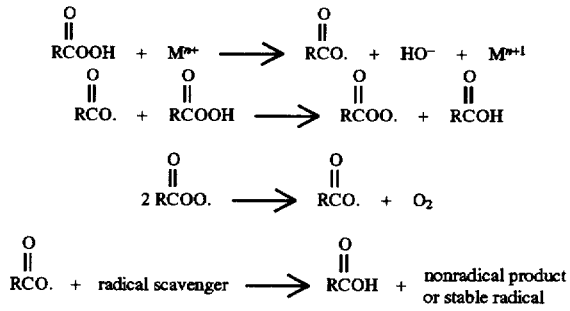

Transition metal catalyzed decomposition can be slowed in two ways. Use of metal sequestrants act by coordinating the metal and preventing the initial electron transfer between metal and peracid. Many sequestrants are known in the art. The most preferred are aminopolyphosphonates which are sold by Monsanto under the tradename "Dequest". Also frequently employed are aminoacetates such as ethylenediaminetetraacetic acid and diethylenetriaminepentaacetic acid. These materials are frequently used to stabilize peracid containing formulations. A second way to mitigate transition metal catalyzed decomposition is by the use of radical scavengers. These materials work by terminating the propagation steps.

EDTA N,N'-dioxide has been shown to act as a radical scavenger by a mechanism involving abstraction of a hydrogen beta to the nitrogen. (See Croft et al J. Chem. Soc. Perkin Trans 2 (1992) p. 153). However, it has never been used to stabilize peracids. Additionally, carboxylate and phosphonate N-oxides have been shown to be capable of metal sequestration, albeit with lower complexing abilities than their non-oxidized counterparts (see Freyer Thesis on EDTA and EDTA oxide; and Carter et al Inorganic Chem. (1967), 6, No. 5, p. 943.)

The present invention is directed to a specific class of N-oxide compounds which applicants have discovered will significantly enhance peracids' stability.

Specifically, these are N-oxides of formula:

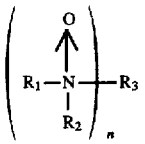

wherein:

$R_1$ and $R_2$ are independently selected from the group consisting of $CH_2CO_2^-$, $CH_2PO_2^-$, $CH_2CO_2H$ and $CH_2PO_3H_2$;

When n is 1, $R_3$ is straight chain or branched $C_1$ to $C_{10}$ alkyl, $CH_2CO_2^-$, $CH_2PO_3^-$, $CH_2CO_2H$, $CH_2PO_3H$, ethoxyalkyl, alkylaminoacetate, polyalkylaminoacetate, alkylaminoacetate N-oxide or polyalkylaminoacetate N-oxide;

When n is 2 to 4, $R_3$ is straight or branched $C_1$ to $C_{10}$ alkylene, ethoxyalkylene, alkylene aminoacetate, polyalkylene aminoacetate, alkylene aminoacetate N-oxide or polyalkylene aminoacetate N-oxide;

n=1 to 4

Examples of such materials are found in J. Chem. Soc. Perkin Trans. 2 (1992), p. 153 and Tenside 4, (1967) p. 65.

Preferred materials are: ethylenediaminetetraacetic acid N, N-dioxide (EDTA-N, N'-dioxide) nitilotriacetic acid N-oxide (NTA-oxide) diethylenetriaminepentaacetic acid N, N'N"-trioxide (DTPA-trioxide) diethylenetriaminepentaacetic acid N,N'-dioxide (DTPA-dioxide) triethylenetetraamine hexaacetic acid N,N'-dioxide (TTHA-dioxide) diethyleneglycol diethylaminotetracarboxylic acid N,N'-dioxide (EGTA-dioxide) ethylenediaminetetrakis (methylenephosphonic acid) N,N'-dioxide hexamethylenediaminetetrakis(methylenephosphonic acid) N, N'-dioxide diethylenetriaminepentakis (methylenephosphonic acid) N,N'-dioxide diethylenetriaminepentakis(methylenephosphonic acid) N,N',N"-trioxide aminotris(methylenephosphoric acid) N-oxide Most preferred is: ethylenediaminetetraacetic acid N, N-dioxide (EDTA-N, N'-dioxide).

The stabilizer system of the invention may comprise an N-oxide compound in combination with a substituted phenolic compound (e.g., 2,6-Di-tert-butyl-4-methylphenol (BHT); or 2-tert-butyl-4-methoxyphenol (BHA)). Such substituted phenols are described in greater detail in applicant's copending application entitled "Aqueous Liquid Compositions Comprising Peracid Compounds and Substituted Phenolic Compounds" concurrently filed with the subject application.

Generally, the stabilizer or mixture of stabilizers is used in an amount comprising 0.01 to 20% by wt. of the composition, preferably 0.01 to 10%, more preferably 0.1 to 5% by weight, most preferably 0.5% to 3.0% by wt.

One preferred stabilization system comprises 0.01 to 5% by wt. N-oxide in combination with 0.01 to 5% by wt. substituted phenolic compound.

Optional Ingredients

Another advantageous component in the heavy-duty liquid laundry detergent compositions of this invention is a deflocculating polymer. Generally, these are used only in the embodiment of the invention wherein the liquid is a duotropic liquid. Copolymers of hydrophilic and hydrophobic monomers usually are employed to form the deflocculating agent. Suitable polymers are obtained by copolymerizing maleic anhydride, acrylic or methacrylic acid or other hydrophilic monomers such as ethylene or styrene sulfonates and the like with similar monomers that have been functionalized with hydrophobic groups. These include the amides, esters, ethers of fatty alcohol or fatty alcohol ethoxylates. In addition to the fatty alcohols and ethoxylates, other hydrophobic groups, such as olefins or alkylaryl radicals, may be used. What is essential is that the copolymer have acceptable oxidation stability and that the copolymer have hydrophobic groups that interact with the lamellar droplets and hydrophilic groups of the structured liquid to prevent flocculation of these droplets and thereby, prevent physical instability and product separation. In practice, a copolymer of acrylic acid and lauryl methacrylate (M.W. about 3800) has been found to be effective at levels of 0.5 to 1.5%. These materials are more fully described in U.S. Pat. No. 4,992,194 (Liberati et al.) herein incorporated by reference.

A number of optional ingredients may also be present, for example lather boosters such as alkanolamides, particularly the monoethanolamides derived from palm kernel fatty acids and coconut fatty acids, fabric softeners such as clays, amines and amine oxides, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and usually present in very minor amounts, fluorescent agents, perfumes, enzymes such as proteases, amylases and lipases (including Lipolase (Trade Mark) ex Novo), germicides and colorants.

The following examples will more fully illustrate the embodiments of this invention and are not intended to limit the claims in any way. All parts, percentages and proportions referred to herein and in the appended claims are by weight unless otherwise illustrated.

EXAMPLES

The experiments performed for this invention utilized a large "base liquid" batch to reduce variability between experiments when evaluating the performance of different stabilizers. The formula for this base liquid is in Table 1 below.

TABLE 1

Base Liquid Formula

| Ingredients | Percent (as received) |
|---|---|
| Vista SA-5197 Alkylbenzene Sulfonic Acid | 29.5% |
| 70% Sorbitol | 16.1% |
| Deionized Water | 15.2% |
| Neodol 25-9 (C12–C15, 9EO Ethoxylated Alcohol) | 12.9% |
| Sodium Citrate 2 aq. | 9.7% |
| 50% Caustic Soda (NaOH) | 7.4% |
| 33% Narlex DC-1 (Decoupling Polymer)* | 5.6% |
| Sodium Borate 5 aq. | 3.7% |

*Acrylate/lauryl methacrylate polymer having MW of about 3–10,000.

Example 1. Procedure for Preparing EDTA N,N'-dioxide

Ethylenediaminetetraacetic acid disodium salt (25 g. 0992 mol) and sodium hydroxide (7.92 g, 0.198 mol) were dissolved in 800 mL water. Oxone® (75 g, 0.122 mol=0.244 mol of potassium monopersulfate) was added portionwise over the course of 1 h while maintaining pH between 6–7 with 50% sodium hydroxide and temperature between 25°–35° C. The mixture was stirred for an additional 15 min then acidified with concentrated sulfuric acid. The white precipitate was filtered on a Buchner funnel to provide 21 g of ethylenediamine tetraacetic acid N,N-dioxide. The melting point of 150° C. corresponds to the literature value of 154° C. for EDTA ½ $H_2O$. MS (electrospray, 1% $NH_4OH$) 323 (M—H).

$^1$H NMR (200 MHz, $D_20$ pH 10) δ4.73 (4H, S, bridging methylenes), 4.60 (4H, d, J=15.7 Hz), 4.42 (4H, d, J=15.7 Hz).

Example 2. Procedure for Making HDL Containing EDTA or EDTA N,N'-dioxide

See Table 1 for quantities.

The water charge is added to a temperature-controlled mixing vessel and allowed to heat to 50° C. Sodium citrate is then added with agitation and is mixed until fully dissolved. The EDTA (disodium salt) or EDTA N,N-dioxide is then charged to the vessel under agitation and allowed to mix until fully dissolved. The sorbitol is then added and is followed immediately by the sodium borate. The caustic soda is then added slowly so that the temperature does not exceed 60° C. This is followed by the Narlex DC-1. The batch is then mixed for 10 minutes and cooled to about 40° C. The sulfonic acid and alcohol ethoxylate are premixed and the premix is then added slowly to the main mix so the temperature does not exceed 50° C. The batch is then mixed and held at 50° C. for 30 minutes and then cooled under mixing until the temperature is approximately 30° C. At this point the TPCAP is added and mixed for 10 minutes and the batch is completed.

Example 3. Procedure for Making HDL with EDTA N,N-dioxide Generated in Situ

See Table 1 for quantities.

1% of the water charge is added to a temperature-controlled mixing vessel followed by the EDTA (disodium salt) and enough 50% sodium hydroxide to bring the pH to 9 and to dissolve the EDTA. Hydrogen peroxide (2 equiv. based on EDTA of a 30% solution) is added and the mixture is brought to 50° C. and held for 3 hr. The remaining water is added followed by sodium citrate. The remaining procedure is as described above in Example 2.

Examples 4–8

The base liquid was mixed with the stabilizers listed below in Table 2, then mixed with the peracid indicated. Example 4 and 5 compare the resulting half-life of TPCAP in the presence of EDTA and EDTA oxide. EDTA oxide stabilizes the peroxyacid acid in the formulation better than EDTA. As seen from Example 6, it stabilizes as well as Dequest. Finally Example 7 shows that an amine oxide with simple alkyl substitution (e.g., trialkyl amine) does not stabilize the peracid. This demonstrates a criticality of the amine oxides of this invention, that is, that they require the acetate or phosphonate substitution. Comparative 2 and Example 8 shows the benefit of EDTA oxide with a different peracid.

TABLE 2

Half-life of TPCAP in presence of various stabilizers

| | Peracid (dosed to 3000 ppm active oxygen) | Stabilizer | Half-life @ 37° C.** |
|---|---|---|---|
| Comparative I | TPCAP | none | 3 days |
| 4 | TPCAP | 0.85% EDTA | 20 days |
| 5 | TPCAP | 0.85% EDTA oxide | 30 days |
| 6 | TPCAP | 1.24% Dequest | 28 days |
| 7 | TPCAP | 0.85% TMANO* | 4 days |
| Comparative 2 | PAP | none | 2 days |
| 8 | PAP | 0.83% EDTA oxide | 6 days |

*TMANO = trimethylamine N-oxide
**Half-life is amount of time it takes peracid to lose half of its initial activity.

Example 9

TABLE 3

Effect of EDTA N-oxide level on the stability of TPCAP peracid in aqueous HDL formulation

| EDTA N-oxide level (%) | TPCAP half-life @ 37° C. |
|---|---|
| 0 | 3 days |
| 0.1 | 27 days |
| 0.5 | 38 days |
| 1.0 | 32 days |
| 2.0 | 31 days |
| 4.0 | 20 days |

TPCAP is dosed at 3000 ppm active oxygen in the formulation

Table 3 shows dose level effect of EDTA N-oxide on TPCAP half-life in aqueous HDL formulation. The data indicates that optimal peracid stability is achieved at between 0.1% and 1.0% EDTA N-oxide.

Example 10

Effect of combinations of EDTA oxide as substituted phenolic compounds on stability of TPCAP peracid in aqueous HDL formulation.

| Stabilizer | TPCAP half-life @ 37° C. |
|---|---|
| 2% EDTA oxide | 21 days |
| 2% BHT | 31 days |
| 1% EDTA oxide & 1% BHT | 39 days |

TPCAP is dosed at 3000 ppm active oxygen in the formulation.

This example shows that mixtures of N-oxide compound and substituted phenolic compounds clearly enhances peracid stability.

We claim:

1. A liquid detergent composition comprising:

(1) 20% to 80% by wt. of a surfactant selected from the group consisting of anionic, nonionic, cationic, amphoteric and zwitterionic surfactants and mixtures thereof;

(2) 0.1 to 40% by wt. of a peroxyacid selected from the group consisting of (a) mono- or percarboxylic acids of formula:

$$R(R^1N)_nC(NR^2)_m-R^3-\overset{O}{\overset{\|}{C}}OOM;$$

wherein

R is selected from the group consisting of $C_1$–$C_{16}$ alkyl, $C_3$–$C_{16}$ cycloalkyl and $C_5$–$C_{12}$ aryl radicals;

$R^1$ is selected from the group consisting of hydrogen, $C_1$–$C_{16}$ alkyl, $C_3$–$C_{16}$ cycloalkyl and $C_1$–$C_{12}$ aryl radicals;

$R^2$ is selected from the group consisting of hydrogen, $C_1$–$C_{16}$ alkyl, $C_3$–$C_{16}$ cycloalkyl and $C_1$–$C_{12}$ aryl radicals and a carbonyl radical that can form a ring together with R when $R^3$ is arylene;

$R^3$ is selected from the group consisting of $C_1$–$C_{16}$ alkylene, $C_5$–$C_{12}$ cycloalkylene and $C_6$–$C_{12}$ arylene radicals;

n and m are integers whose sum is 1; and

M is selected from the group consisting of hydrogen, alkali metal, alkaline earth metal, ammonium and alkanol ammonium cations and radicals;

(b) di-percarboxylic acids of formula:

$$MOO\overset{O}{\overset{\|}{C}}R^4(R^5N)_{m'}C(NR^6)_{n'}-R^3-(R^6N)_{m''}C(NR^5)_{n''}\overset{O}{\overset{\|}{C}}R^4COOM$$

wherein:

$R^4$ is selected from the group consisting of $C_1$–$C_{12}$ cycloalkylene, $C_5$–$C_{12}$ alkylene cycloalkylene, $C_6$–$C_{12}$ arylene and radical combinations thereof;

$R^5$ is selected from the group consisting of hydrogen, $C_1$–$C_{16}$ alkyl and $C_6$–$C_{12}$ aryl radicals and a carbonyl radical that can form a ring together with $R^3$;

$R^6$ is selected from the group consisting of hydrogen, $C_1$–$C_{16}$ alkyl and $C_6$–$C_{12}$ aryl radicals and a radical that can form a $C_3$–$C_{12}$ ring together with $R^3$;

$R^3$ is selected from the group consisting of $C_1$–$C_{12}$ alkylene, $C_5$–$C_{12}$ cycloalkylene and $C_6$–$C_{12}$ arylene radicals;

n' and n" each are an integer chosen such that the sum thereof is 1;

m' and m" each are an integer chosen such that the sum thereof is 1; and

M is selected from the group consisting of hydrogen, alkali metal, alkaline earth metal, ammonium and alkanolammonium cations and radicals; and (c) ω-phthalimido peroxyhexanoic acid (PAP); and (3) 0.01 to 20.0% by wt. of an N-oxide compound of formula:

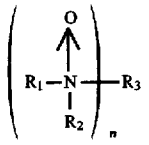

wherein:

$R_1$ and $R_2$ are independently selected from the group consisting of $CH_2CO_2^-$, $CH_2PO_2^-$, $CH_2CO_2H$ and $CH_2PO_3H_2$;

when n is 1, $R_3$ is straight chain or branched $C_1$ to $C_{10}$ alkyl, $CH_2CO_2^-$, $CH_2PO_3^-$, $CH_2CO_2H$, $CH_2PO_3H$, ethoxyalkyl, alkylaminoacetate, polyalkylaminoacetate, alkylaminoacetate N-oxide or polyalkylaminoacetate N-oxide;

when n is 2 to 4, $R_3$ is straight or branched $C_1$ to $C_{10}$ alkylene, ethoxyalkylene, alkylene aminoacetate, polyalkylene aminoacetate, alkylene aminoacetate N-oxide or polyalkylene aminoacetate N-oxide;

n=1 to 4.

2. A composition according to claim 1, wherein the peroxyacid is selected from the group consisting of N,N'-Terephthaloyl-di(6-aminopercarboxycaproic acid) (TPCAP), N,N'-Di(4-percarboxybenzoyl)piperazine (PCBPIP); N,N'-Di(4-Percarboxybenzoyl)ethylenediamine (PCBED); N,N'-di(4-percarboxybenzoyl)-1,4-butanediamine (PCBBD); N,N'-Di(4-Percarboxyaniline) terephthalate (DPCAT); N,N'-Di(4-Percarboxybenzoyl)-1,4-diaminocyclohexane (PCBHEX); N,N'-Terephthaloyl-di (4-amino peroxybutanoic acid) (TPBUTY); N,N'-Terphthaloyl-di(8-amino peroxyoctanoic acid); (TPOCT), N,N'-Di(percarboxyadipoyl)phenylenediamine (DPAPD); and N,N'-Succinoyl-di(4-percarboxy)aniline (SDPCA).

3. A composition according to claim 2, wherein the peroxyacid is N,N'-terephthaloyl-Di-6-aminoperoxy caproic acid (TPCAP).

4. A composition according to claim 1, wherein the N-oxide compound is ethylenediaminetetraacetic acid, N,N' dioxide (EDTA-oxide).

5. A composition according to claim 1, comprising 0.5–10% by wt. N-oxide compound.

6. A composition according to claim 1, comprising 0.5–5% by wt. N-oxide compound.

7. A composition according to claim 1, comprising additionally comprising 0.01 to 20% by wt. of a substituted phenolic compound.

8. A composition according to claim 7 comprising 0.5 to 5% by wt. N-oxide and 0.5% to 5% by wt. substituted phenolic compound.

9. A composition according to claim 8, wherein the substituted phenolic compound is 2,6-di-tert-butyl-4-methylphenol (BHT).

10. A method for enhancing stability in liquid aqueous compositions comprising:

(1) 20% to 80% by wt. of a surfactant selected from the group consisting of anionic, nonionic, cationic, amphoteric, and zwitterionic surfactants and mixtures thereof; and (2) 0.1% to 40% by wt. of a peroxyacid selected from the group consisting of:

(a) mono- or percarboxylic acids of the formula:

$$R(R^1N)_nC(NR^2)_m-R^3-\overset{O}{\overset{\|}{C}}OOM;$$

wherein

R is selected from the group consisting of $C_1$–$C_{16}$ alkyl, $C_3$–$C_{16}$ cycloalkyl and $C_6$–$C_{12}$ aryl radicals;

$R^1$ is selected from the group consisting of hydrogen, $C_1$–$C_{16}$ alkyl, $C_3$–$C_{16}$ cycloalkyl and $C_1$–$C_{12}$ aryl radicals;

$R^2$ is selected from the group consisting of hydrogen, $C_1$–$C_{16}$ alkyl, $C_3$–$C_{16}$ cycloalkyl and $C_1$–$C_{12}$ aryl radicals and a carbonyl radical that can form a ring together with R when $R^3$ is arylene;

$R^3$ is selected from the group consisting of $C_1$–$C_{16}$ alkylene, $C_6$–$C_{12}$ cycloalkylene and $C_6$–$C_{12}$ arylene radicals;

n and m are integers whose sum is 1; and

M is selected from the group consisting of hydrogen, alkali metal, alkaline earth metal, ammonium and alkanol ammonium cations and radicals; and (b) di-percarboxylic acids of formula:

$$MOOCR^4(R^5N)_nC(NR^6)_{n'}-R^3-(R^6N)_{m'}C(NR^5)_mR^4COOM$$

wherein:

$R^4$ is selected from the group consisting of $C_1$–$C_{12}$ cycloalkylene, $C_5$–$C_{12}$ alkylene cycloalkylene, $C_6$–$C_{12}$ arylene and radical combinations thereof;

$R^5$ is selected from the group consisting of hydrogen, $C_1$–$C_{16}$ alkyl and $C_6$–$C_{12}$ aryl radicals and a carbonyl radical that can form a ring together with $R^3$;

$R^6$ is selected from the group consisting of hydrogen, $C_1$–$C_{16}$ alkyl and $C_6$–$C_{12}$ aryl radicals and a radical that can form a $C_3$–$C_{12}$ ring together with $R^3$;

$R^3$ is selected from the group consisting of $C_1$–$C_{12}$ alkylene, $C_5$–$C_{12}$ cycloalkylene and $C_6$–$C_{12}$ arylene radicals;

n' and n" each are an integer chosen such that the sum thereof is 1;

m' and m" each are an integer chosen such that the sum thereof is 1; and

M is selected from the group consisting of hydrogen, alkali metal, alkaline earth metal, ammonium and alkanolammonium cations and radicals; and (c) ω-phthalimido peroxyhexanoic acid (PAP);

wherein said method comprises adding 0.05% to 5.0% by wt. of an N-oxide compound, wherein said compound is

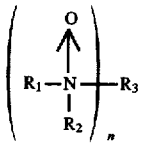

wherein:

$R_1$ and $R_2$ are independently selected from the group consisting of $CH_2CO_2^-$, $CH_2PO_3^-$, $CH_2CO_2H$ and $CH_2PO_3H_2$;

when n is 1, $R_3$ is straight chain or branched $C_1$ to $C_{10}$ alkyl, $CH_2CO_2^-$, $CH_2PO_3^-$, $CH_2CO_2H$, $CH_2PO_3H$, ethoxyalkyl, alkylaminoacetate, polyalkylaminoacetate, alkylaminoacetate N-oxide or polyalkylaminoacetate N-oxide;

when n is 2 to 4, $R_3$ is straight or branched $C_1$ to $C_{10}$ alkylene, ethoxyalkylene, alkylene aminoacetate, polyalkylene aminoacetate, alkylene aminoacetate N-oxide or polyalkylene aminoacetate N-oxide; and n=1 to 4.

* * * * *